United States Patent [19]

Herrmann

[11] 4,087,942

[45] May 9, 1978

[54] STEEL DOOR CONSTRUCTION

[75] Inventor: Frank P. Herrmann, Miramar, Fla.

[73] Assignee: Precision Industries, Inc., Miami, Fla.

[21] Appl. No.: 784,041

[22] Filed: Apr. 4, 1977

[51] Int. Cl.[2] ..... E06B 3/00

[52] U.S. Cl. ..... 49/501

[58] Field of Search ..... 49/501, 504, 399, 400, 49/401, 507; 52/619

[56] References Cited

U.S. PATENT DOCUMENTS

| | | | |
|---|---|---|---|
| 1,574,493 | 2/1926 | Leonard | 49/501 |
| 2,853,162 | 9/1958 | David et al. | 49/399 X |
| 2,948,366 | 8/1960 | Kelly et al. | 49/501 |
| 3,267,626 | 8/1966 | Daly | 52/619 X |

*Primary Examiner*—Kenneth Downey

*Attorney, Agent, or Firm*—Ernest H. Schmidt

[57] ABSTRACT

A steel door fabricated of sheet steel and having inner and outer end panels retained in spaced relation by inwardly-bent vertical edge portions has a plurality of inwardly-swaged recesses spaced along one edge of the door for the flush reception of hinge plates securable in place by the use of sheet metal screws received in bent sheet metal hinge support plates fixed within the door behind each of the recesses. The hinged edge of the door is formed along its length with a central, outwardly-extending portion of rectangular cross-sectional configuration along which the hinge plate recesses are formed and which, at the inside of the door, define side-wall portions within which complementary side wall portions of the bent metal hinge support plates are snugly received.

6 Claims, 7 Drawing Figures

STEEL DOOR CONSTRUCTION

This invention relates to steel doors, and is directed particularly to improvements in the construction of steel doors permitting door hinge plates to be secured in place within recesses provided along the hinged edge of the door so as to lie substantially flush with the door edge.

Various devices have heretofore been provided for attaching door hinge plates to the hinged edge of metal doors so that the hinged plates do not project outwardly of the door edge. Such devices heretofore utilized, however, are deficient in various respects, particularly in that they require specially designed hinges. It is the principal object of this invention to provide a steel door with recesses along the hinged edge for the reception of the hinge plates of standard, so-called "butt" hinges and including a bent sheet metal hinge support plate within the door behind each of the hinge recesses for the reception of hinge mounting screws.

A more particular object of the invention is to provide a bent sheet metal door of the character described wherein the hinged edge of the door is formed along its length with a central, outwardly-extending portion of rectangular cross-sectional configuration along which the hinge plate recesses are formed as by a swadging operation, and wherein the recesses are provided with bottom openings for the free passage of hinge mounting screws received for securement in their respective hinge support plates.

Another object of the invention is to provide a steel door construction of the above nature wherein the bent metal hinge support plates comprise centrally-apertured, inwardly-directed, frusto-conical portions adapted to receive hinge mounting sheet metal screws and operative to flex in cinching relation about the mounting screws upon their being tightened in place.

Still another object of the invention is to provide a steel door with hinge plate recesses comparable with hinge mortised edges of wood doors and adapted to receive standard "butt hinges" to provide for hanging of the steel door in the same manner and with no more difficulty than may be experienced in hanging an ordinary wood door.

Yet another object of the invention is to provide a steel door construction of the above nature including thermal barrier means between the inner and outer door panels for minimizing thermal conductivity between the inside and the outside of the door.

Another object of the invention is to provide a novel and improved steel door construction of the character described which will be simple in construction, economical to manufacture, easy to install, attractive in appearance and dependable in use.

Other objects, features and advantages of the invention will be apparent from the following description when read with reference to the accompanying drawings. In the drawings, wherein like references denote corresponding parts throughout the several views.

Figure 1:
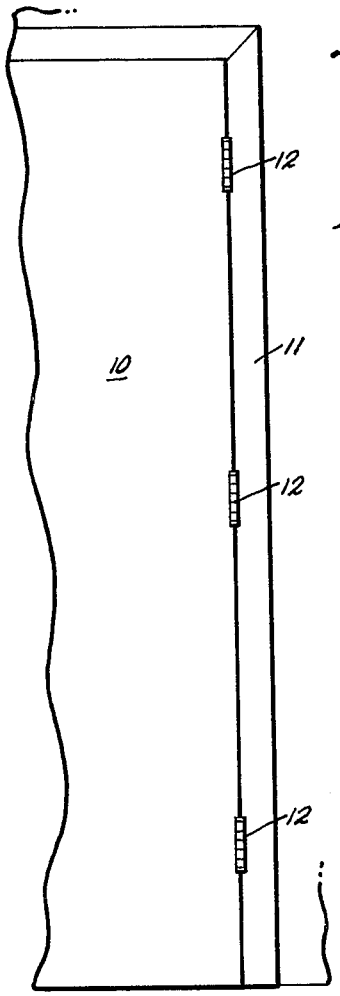
FIG. 1 is a partial, inside elevational view of a steel door embodying the invention, shown installed in a door frame.

Referring now in detail to the drawings, reference numeral 10 designates, generally, a steel door embodying the invention, shown assembled to a door frame 11 (see FIG. 1), also preferably of metal, by the use of ordinary butt hinges 12. The steel door 10 comprises an inner face panel of sheet metal 13 and an outer face panel of sheet metal 14 held in spaced, parallel relation defining an interior chamber which may be filled with foam plastic or the like for insulating purposes (not illustrated). The inner longitudinal edge, that is, the hinge edge of the door 10, is formed by bending marginal longitudinal end portions of the inner and outer sheet metal panels 13 and 14, and comprises an inwardly-bent marginal edge marginal edge portion 15, said inwardly bent portion merging with a longitudinally-extending, outwardly-extending portion 16 of rectangular cross-sectional configuration terminating in an inwardly-directed, reversely-bent, longitudinally-extending portion of U-shaped configuration defined by opposed side-wall portions 18 and 19. The outer face wall 14 has a narrow, inwardly-bent, vertically-extending portion 17 which extends into an inwardly right-angularly bent terminal end portion 20. The longitudinally extending end portion 20 is enveloped by a length of plastic strip material 21, such as of vinyl chloride, bent into U-shape along its length and received within the zone defined by reversely bent portions 18, 19 of the inner face panel 13 so as to be clamped therebetween. The synthetic plastic separator strip serves to thermally insulate the inner door panel 13 with respect to the outer door panel 14. In this connection, it is to be understood that, although not illustrated, the edge of the door opposite the inner or hinged edge is similarly mechanically interjoined with the inclusion of a synthetic strip thermal barrier.

Figure 2:
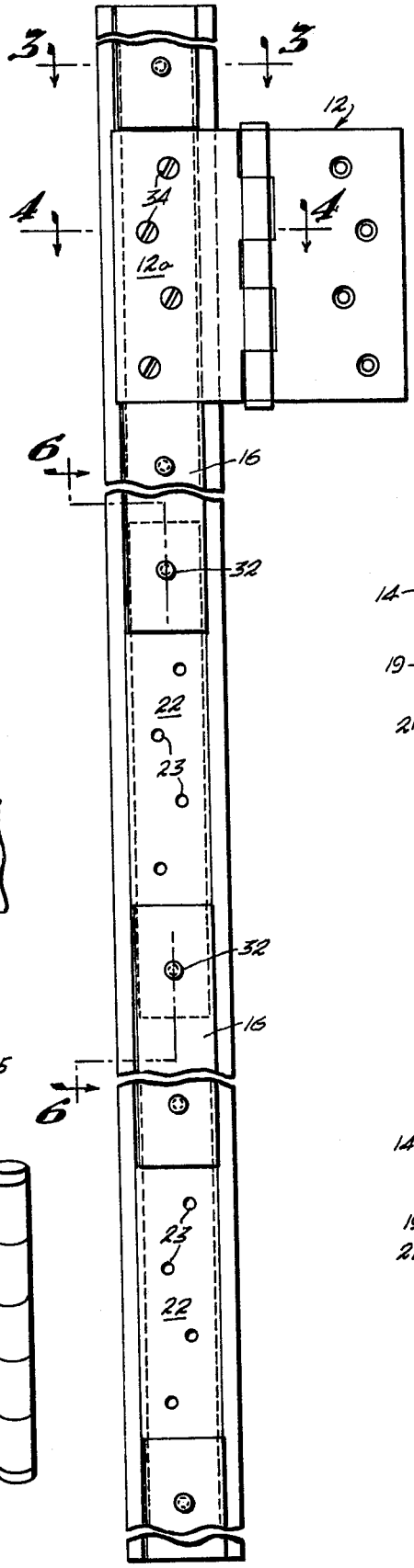
FIG. 2 is an elevational view, with portions broken away, of the inner edge of the steel door shown in FIG. 1, illustrating the butt hinge recesses therein.
Figure 3:
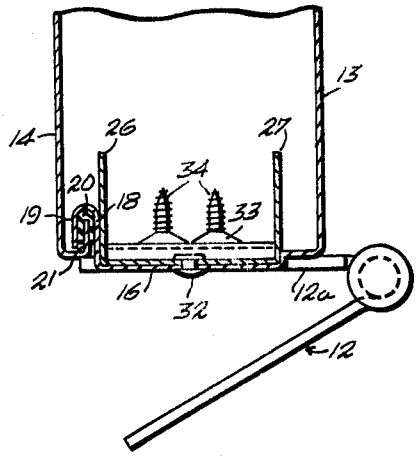
FIG. 3 is a partial horizontal cross-sectional view taken along the line 3—3 of FIG. 2 in the direction of the arrows and illustrating details of assembly of one of the butt hinges in a door hinge plate recess.
Figure 5:
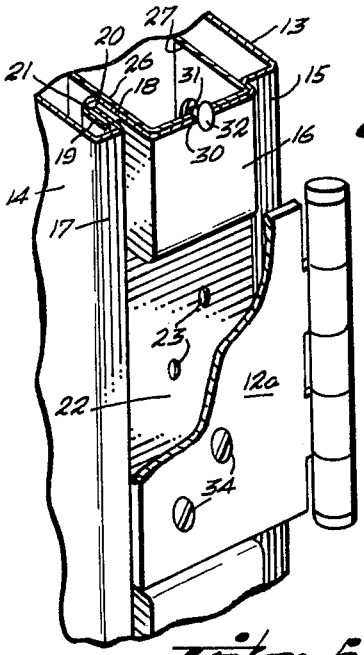
FIG. 5 is a partial oblique view of a edge portion of the steel door illustrating details of door construction and one of the internal hinge support brackets.
Figure 4:
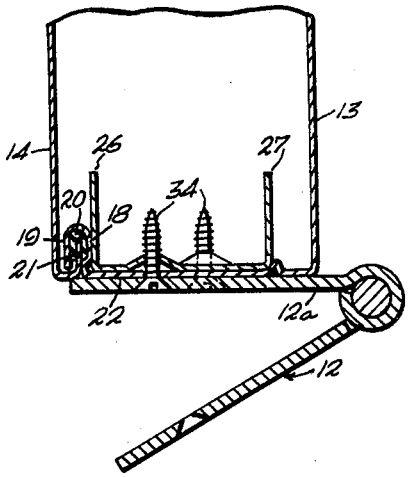
FIG. 4 is a partial horizontal cross-sectional view taken along the line 4—4 of FIG. 2 in the direction of the arrows and further illustrating details of hinge assembly.
Figure 6:
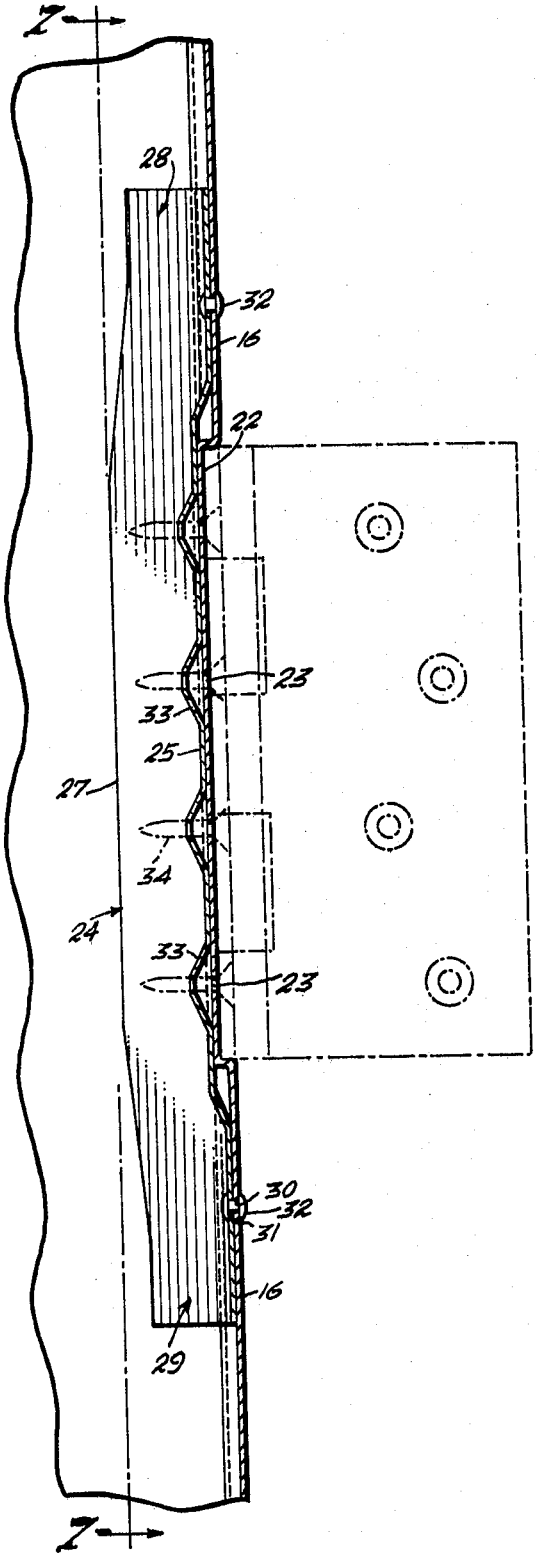
FIG. 6 is a vertical cross-sectional view taken along the line 6—6 of FIG. 2 in the direction of the arrows.
Figure 7:
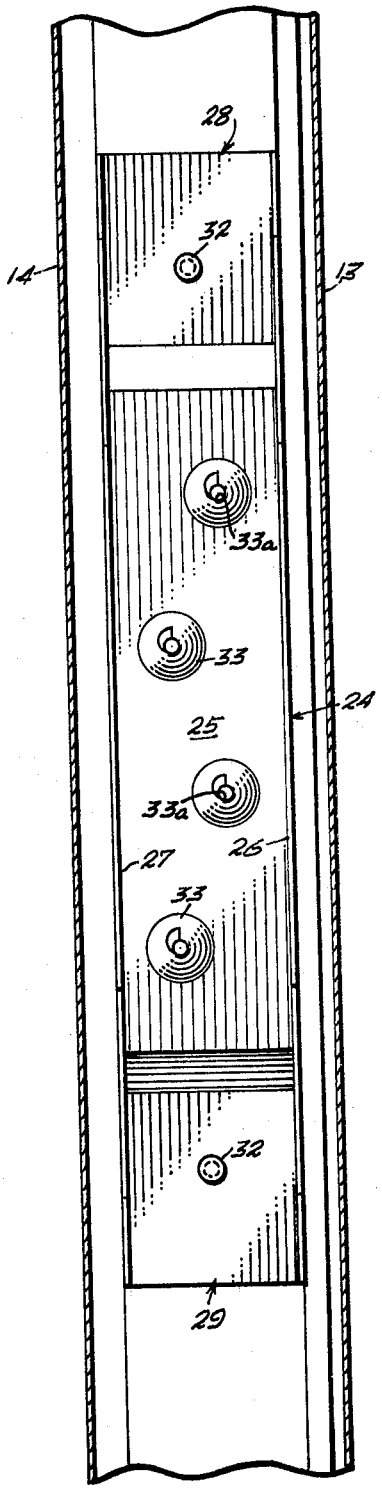
FIG. 7 is a longitudinal cross-sectional view taken along the line 7—7 of FIG. 6 in the direction of the arrows.

As best illustrated in FIGS. 1, 2 and 5, the outwardly-extending portion 16 along the hinged edge of the door is swaged or otherwise inwardly pressed or deformed to provide a plurality, 3 in the embodiment illustrated, of recesses 22 of such length as to receive, fitted therein in face-to-face engagement, one plate **12*a* of hinge 12. Each of the recesses 22 is provided with a plurality of openings 23 (see FIGS. 2 and 5) in register with the screw hole openings in the abutting hinge plate 12*a* for attachment of the hinges in the manner hereinafter more particularly described. It will be understood that the depth of the recesses 22 will be such as to receive both hinge leaves when folded together, that is, when the hinge door is closed, whereby the outer side of the outer hinge plate will lie in substantially the same plane as that of the outwardly-extending door edge portion 16. Support means comprising support brackets 24 are provided for each of the door edge recesses 22 to enable securement in place of the respective hinges with use of ordinary sheet metal screws. To this end, each support bracket member 24, which will preferably be fabricated of tempered sheet steel, is of generally U-shaped cross-sectional configuration comprising a web portion 25 and opposed, parallel side wall portions 26, 27. The longitudinal ends of each of the support bracket members 24 are offset outwardly of the outer face of the web portions 25 thereof, as indicated at 28 and 29, to define a shape complemental with that of the recesses 22 along the hinged edge of the door so as to fit in face-to-face relation against the insides of said recesses, as best illustrated in FIGS. 6 and 7. Aligned openings 30 and 31 in the support bracket members 24 at each end thereof, and in the outwardly-extending portion 16 of the hinge edge of the door 10, provide for the use of rivets 32 in securing said support bracket members in place. The support bracket members 22 are also provided, in their respective web portions 25, with a plurality of conical depressions 33 in register with respective openings 23 in the recesses 22, and the apices of which are apertured, as indicated at 33***a*, to receive sheet metal screws 34 for secure attachment of a hinge plate 12*a*. It will be understood that the conical depressions 33 in the support bracket members 24 not only serve as guide means for locating the hinge securing screws in their respective attachment openings 33*a*, but also enhance the rigidity of said support bracket members in their attachment zones to insure secure and lasting hinge attachment, even under high stress conditions.

While I have illustrated and described herein only one form in which my invention can conveniently be embodied in practice, it is to be understood that this embodiment is given by way of example only and not in a limiting sense. My invention, in brief, comprises all the embodiments and modifications coming within the scope and spirit of the following claims:

What I claim as new and desire to secure by Letters Patent is:

1. A steel door comprising, in combination, a sheet metal inner panel and a sheet metal outer panel in mutually-spaced parallel disposition, marginal side portions of said inner and outer panels being inwardly bent towards one another to define a hinging door edge, means mechanically interjoining terminal end portions of said marginal side portions of said inner and outer panels for securing said panels in said spaced relation, said door edge having a plurality of longitudinally-spaced, inwardly-bent portions defining shallow recesses for the reception, one each, of butt hinge plates for hanging the door, a bent sheet metal bracket member within the door behind each of said recesses and having screw retainer means for receiving butt hinge plate screws extending through apertures in bottom wall portions of said recesses, said marginal side portions of said inner and outer panels being bent to define, along the length of the door, a central, outwardly-extending portion of rectangular cross-sectional configuration within which said shallow recesses are formed, said bent metal bracket member being U-shaped in cross-sectional configuration and having opposed outer side wall portions, longitudinal end portions of which are snugly received between the opposing side wall portions within the door as defined by said outwardly-extending portion along the length of the door, and means for securing said longitudinal end portions of said bracket member to said hinging door edge.

2. A steel door as defined in claim 1 wherein said metal bracket member comprises a plurality of conical depressions in register with respective openings in said bottom wall portion of its pertaining recess and extending inwardly of the door, the apices of said conical depressions being apertured for the reception of hinge plate attachment screws.

3. A steel door as defined in claim 2 wherein said longitudinal end portions of said bracket member are offset outwardly of the central face of said support bracket.

4. A steel door as defined in claim 3 wherein said mechanical interjoining means comprises a thermal barrier.

5. A steel door as defined in claim 4 wherein said mechanical interjoining means comprises a longitudinally-extending portion of U-shaped configuration extending longitudinally of one of said terminal end portions, an inwardly-bent portion extending along said other terminal end portion and received within the recess defined by said portion of U-shaped configuration, said thermal barrier means comprising a length of plastic strip material of U-shaped cross-sectional configuration clamped between said portion of U-shaped configuration and said inwardly bent portion.

6. A steel door as defined in claim 5 wherein said recesses are of such depth that the outer surface of a hinge plate, when secured in place therein, will lie substantially flush with the outer surface of said hinging door edge.

* * * * *